US005281477A

United States Patent [19]

Nakatani et al.

[11] Patent Number: 5,281,477

[45] Date of Patent: Jan. 25, 1994

[54] CARBON FIBERS HAVING HIGH TENACITY AND HIGH MODULUS OF ELASTICITY AND PROCESS FOR PRODUCING THE SAME

[75] Inventors: Munetsugu Nakatani; Yoshitaka Imai; Hiroaki Yoneyama, all of Ohtake; Yoshiteru Tanuku, Kawasaki, all of Japan

[73] Assignee: Mitsubishi Rayon Co., Ltd., Tokyo, Japan

[21] Appl. No.: 682,383

[22] Filed: Apr. 9, 1991

Related U.S. Application Data

[63] Continuation of Ser. No. 120,691, Nov. 9, 1987, abandoned, which is a continuation of Ser. No. 731,950, Apr. 26, 1985, abandoned.

[30] Foreign Application Priority Data

| | | | |
|---|---|---|---|
| Oct. 13, 1983 | [JP] | Japan | 58-191291 |
| Oct. 13, 1983 | [JP] | Japan | 58-191292 |
| Oct. 13, 1983 | [JP] | Japan | 58-191293 |
| Oct. 13, 1983 | [JP] | Japan | 58-191294 |

[51] Int. Cl.[5] ..... D02G 3/00

[52] U.S. Cl. ..... 428/367; 423/447.1; 423/447.2; 423/447.4; 264/29.2

[58] Field of Search ..... 428/367; 423/447.1, 423/447.2

[56] References Cited

U.S. PATENT DOCUMENTS

| | | | |
|---|---|---|---|
| Re. 30,414 | 10/1980 | Kinoshita | 423/447.2 X |
| 4,609,540 | 9/1986 | Izumi et al. | 423/447.2 X |
| 4,628,001 | 12/1986 | Sasaki et al. | 428/367 |
| 4,714,642 | 12/1987 | McAliley et al. | 423/447.2 X |
| 5,047,292 | 9/1991 | Sadanobu et al. | 428/367 |
| 5,167,945 | 12/1992 | Ogawa et al. | 423/447.1 |

FOREIGN PATENT DOCUMENTS 0165465 12/1985 European Pat. Off. .

*Primary Examiner*—Patrick J. Ryan
*Assistant Examiner*—J. M. Gray
*Attorney, Agent, or Firm*—Oblon, Spivak, McClelland, Maier & Neustadt

[57] ABSTRACT

A carbon fiber of a high tenacity and a high modulus of elasticity having a fiber diameter of 1 to 6 μm, a strand tenacity of 430 kg/mm² or more, a strand modulus of elasticity of 28 ton/mm² or more and a density of 1.755 g/cm³ or more, and a process for producing the same.

The above-mentioned carbon fiber has extremely useful properties as a raw material for composite materials to be used not only for sporting goods such as fishing rods or golf clubs but also in aerospace industries.

2 Claims, 1 Drawing Sheet

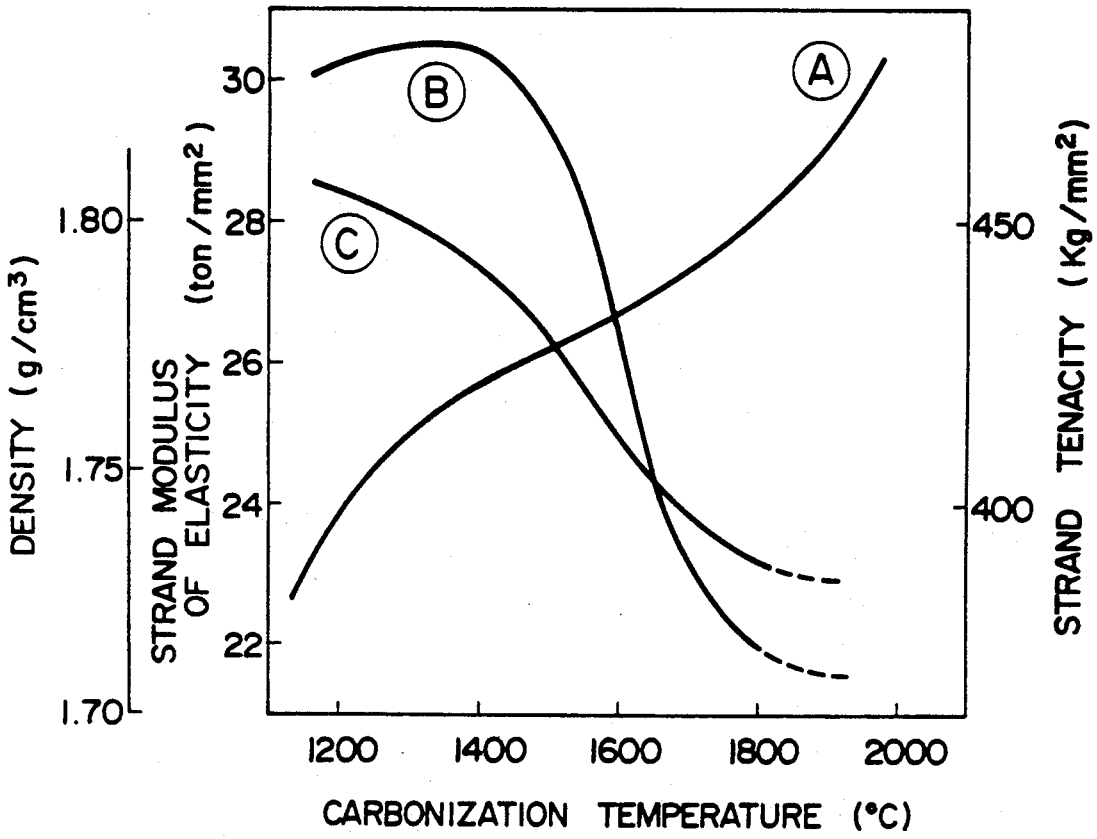
DENSITY (g/cm³)
1.80
1.75
1.70
STRAND MODULUS OF ELASTICITY (ton/mm²)
30
28
26
24
22
STRAND TENACITY (Kg/mm²)
450
400
A
B
C
1200
1400
1600
1800
2000
CARBONIZATION TEMPERATURE (°C)

CARBON FIBERS HAVING HIGH TENACITY AND HIGH MODULUS OF ELASTICITY AND PROCESS FOR PRODUCING THE SAME

This is a continuation of application Ser. No. 07/120,691, filed on Nov. 9, 1987, now abandoned, which is a continuation of application Ser. No. 06/731,950, filed Apr. 26, 1985, now abandoned.

TECHNICAL FIELD

This invention relates to a carbon fiber having a high tenacity and a high modulus of elasticity and a process for producing the same.

BACKGROUND ART

In recent years, carbon fiber composite materials have been used in a wide field of applications including sports, aerospaces and industries and the consumption thereof is remarkably increasing in quantity. In correspondence to such conditions, the properties of carbon fibers used are also being improved by leaps and bounds.

In regard to the modulus of elasticity of carbon fibers, whereas it was about 20 ton/mm$^2$ ten years ago, 23–24 ton/mm$^2$ became its standard value several years ago. Further, recent efforts in development are being directed to attaining a modulus of elasticity of about 30 ton/mm$^2$, and it is generally believed that such a value would become the mainstream of the moduli of elasticity of carbon fibers.

However, if such improvement of the modulus of elasticity of a carbon fiber is achieved while keeping the tenacity of the carbon fiber at a constant value, it will naturally cause the decrease of elongation of the carbon fiber, which will result in brittleness of carbon fiber composite materials produced by using such carbon fibers and in lowering the reliability of the properties of the composite materials.

Accordingly, there is a strong need at present for a carbon fiber having a high modulus of elasticity and a high elongation, in other words, a carbon fiber having a characteristic that it has a high elongation and at the same time has a high tenacity.

Conventional methods for improving the modulus of elasticity of a carbon fiber comprised increasing the carbonization temperature, namely the ultimate heat-treatment temperature, of the carbon fiber. However, though such a method is effective in improving the modulus of elasticity of carbon fibers, it has a defect in that the improvement is accompanied by the decrease in the tenacity of the carbon fibers and consequently results in the decrease in the elongation of the fibers. The attached drawing is a graph showing the correlation between the carbonization temperature of a carbon fiber and the physical properties of the resulting carbon fiber to illustrate such situations. As shown in the drawing, with the increase of the carbonization temperature of a carbon fiber, the modulus of elasticity of the fiber increases as indicated by curve (A), whereas the tenacity and the density of the carbon fiber decrease as shown by curves (B) and (C) in the drawing in keeping with the above increase of the modulus.

For example, a temperature of about 1800° C. is fibers obtained according to the above invention has a tenacity of 360 to 420 kg/mm$^2$ and a modulus of elasticity of fiber strand of high tenacity and high modulus of elasticity.

BRIEF DESCRIPTION OF THE DRAWING

The attached drawing is a graph showing relationships of the carbonization temperature with the strand tenacity, the strand modulus of elasticity and the density of a carbon fiber obtained by a prior method.

DISCLOSURE OF THE INVENTION

The present inventors have made extensive studies to obtain a carbon fiber having a characteristic of being both of high elongation and of high modulus of elasticity mentioned above and, as a result, accomplished this invention.

The essential features of this invention are carbon fibers of a high tenacity and a high modulus of elasticity having characteristics of a fiber diameter of 1;to 6 μm, a strand tenacity of 430 kg/mm$^2$ or more, a strand modulus of elasticity of 28 ton/mm$^2$ or more and a fiber density of 1.755 g/cm$^3$ or more, and a process for producing the same.

BEST MODE FOR CARRYING OUT THE INVENTION

The carbon fiber of this invention can be produced by using an acrylonitrile-type fiber as a precursor, subjecting it to a flame-resisting treatment under specified necessary for carbonization of a carbon fiber in order to produce a carbon fiber having a modulus of elasticity of 28 ton/mm$^2$. As is shown from the drawing, a carbon fiber obtained by a heat treatment at the above-mentioned temperature has a tenacity of about 370 kg/mm$^2$, which is 100 kg/mm$^2$ or more lower than the tenacity of a carbon fiber obtained by treating at 1300° C., 470 kg/mm$^2$, and thus is far from being a high-tenacity carbon fiber. Further, the fiber has a decreased elongation of 1.3% or less. As is shown in the drawing, such lowering in tenacity accompanying the increase of carbonization temperature is in good correspondence to the decrease of the density of the fiber, and is assumed to be caused by generation of microscopic voids in the fiber during the course of elevating the carbonization temperature, which voids cause the lowering of the tenacity.

Thus, since the conventional techniques of elevating the treating-temperature of carbonized fibers to obtain carbon fibers having a high modulus of elasticity have the disadvantage that the tenacity of resulting carbon fibers is sharply lowered, a high performance carbon fiber having a characteristic that it has both a high tenacity and a high elongation cannot be obtained by such methods. For example, there have been disclosed in Japanese Patent Application Kokai (Laid-open) Nos. 94,924/74 and 42934/82 inventions for producing a carbon fiber which comprise subjecting a bundle of acrylonitrile-type fibers of fine size to a flame-resisting treatment followed by carbonization.

In the former invention, acrylonitrile-type fibers which have been formed from an acrylonitrile-type polymer having an intrinsic viscosity of 1.5 or more, particularly 1.5 to 1.87, and whose single yarn has a fineness of 0.3 to 0.6 denier and a coefficient of fineness variation of 15% or less are subjected to a flame-resisting treatment in the air at a temperature of 200° to 300° C., then to a carbonization treatment in an inert atmosphere at a temperature of 1200° to 1600° C. to give carbon fibers having a single fiber tenacity of 260 to 360 kg/mm$^2$ and a modulus of elasticity of 26 to 27.5 ton/mm$^2$ However, since the tenacity and the Young's modulus of elasticity of each of the carbon fibers vary considerably with one another, the tenacity and the Young's modulus of a strand of the carbon fibers produced by such a method are usually 10% or more lower than the respective values mentioned above.

In the latter invention, acrylonitrile-type fibers having a single fiber fineness of 0.02 to 0.6 denier and a fiber tenacity of 6 g/denier are subjected to a heat treatment in the air at 240° to 300° C. under conditions such that a shrinkage of 4 to 10% is given to the fiber until the equilibrium moisture content of the heat-treated fiber reaches 5%, then further given a shrinkage of 2 to 8% to complete the flame-resisting treatment, and then subjected to a carbonization treatment in an inert atmosphere at a temperature of 1000° to 1800° C. to give carbon fibers having a single fiber diameter of 1 to 6 μm and a knot strength of the strand of 7 kg or more. However, the strand of the carbon conditions, dividing the carbonization step into a low temperature carbonization step at 800° C. or lower and a high temperature carbonization step at 1000° C. or higher, particularly at 1300° to 1650° C., and applying to the fiber a sufficient elongation in the low temperature carbonization step.

The acrylonitrile-type fibers used in carrying out the present invention refer to those which are produced by forming into fibers a homopolymer of acrylonitrile or a copolymer of 85% by weight or more of acrylonitrile with one or more other copolymerizable vinyl monomers.

Examples of other vinyl monomers copolymerizable with acrylonitrile include methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; vinyl-sulfonic acid and the salts thereof.

The acrylonitrile-type polymers can be produced from the above-mentioned monomers by solution polymerization using solvents such as aqueous zinc chloride solution or dimethyl sulfoxide or by aqueous suspension polymerization using a redox catalyst consisting of a combination of ammonium persulfate and acid ammonium sulfate.

When an acrylonitrile-type polymer contaminated with impurities having a particle diameter of 10 μm or more is formed into fibers and heat-treated to give carbon fibers, the resultant carbon fibers will have fiber defects formed at the parts contaminated with the impurities, which results in marked deterioration of the tenacity of the carbon fibers. Accordingly, the monomers and solvents to be used in polymerization are preferably used after freed from impurities having a size of 10 μm or more, particularly 3 μm or more, by distillation or precise filtration.

The acrylonitrile-type polymer to be used has preferably an intrinsic viscosity of about 1.5 to 3.5. Particularly, those having an intrinsic viscosity in the range of 1.8 to 2.8 can give carbon fiber strands having excellent properties.

The acrylonitrile-type fibers used in this invention have preferably a single fiber fineness of 1.5 denier or less, particularly 0.1 to 1.1 denier. Acrylonitrile-type fibers having a large single fiber fineness exceeding 1.5. denier tend to give rise to objectionable voids in the fibers during the steps of flame-resisting and carbonization, and hence are not suitable as a precursor for producing carbon fibers having a high tenacity and a high modulus of elasticity, particularly carbon fiber strands of high performances.

The acrylic fibers of fine sizes used in this invention are preferably produced by wet spinning, dry-wet spinning or like processes. For example, an acrylonitrile-type polymer is dissolved in an inorganic solvent such as aqueous zinc chloride solution, aqueous rhodanate solution and aqueous nitric acid solution or an organic solvent such as dimethylformamide, dimethylacetamide, dimethyl sulfoxide and γ-butyrolacetone to a solid concentration of 15 to 30% by weight to form a spinning dope, which is then spun into a coagulation bath comprising an aqueous solution of above-mentioned solvents to be coagulated. The coagulated fibers are stretched, washed and dried to increase their density. If necessary, they may be further subjected to a secondary stretching such as dry-heat stretching or steam stretching.

When the acrylic fibers thus obtained contain impurities having a particle diameter of 5 μm or more they are hardly be used for producing a high-preformance carbon fiber strand intended in this invention. Accordingly, dopes used for producing the acrylonitrile-type fibers are preferably filtered so as to be freed from impurities having a particle diameter of 10 μm or more.

Similarly, it is preferable to filter also the solutions to be used for the coagulation bath, the water-washing bath and the stretching bath.

Further, the acrylic fibers used in this invention have preferably a coefficient of fineness variation of 15% or less.

The acrylonitrile-type fibers obtained as mentioned above contain no impurity nor internal void and has no surface defects such as crazes and cracks.

The acrylic fibers thus obtained are subjected to treatments of flame-resisting, primary carbonization and secondary carbonization according to the heat-treatment process of this invention.

The flame-resisting treatment is usually conducted in an oxygen-nitrogen mixture atmosphere such as air, but it may also be conducted in nitrogen monoxide or sulfurous acid gas. The temperature in the flame-resisting treatment is suitably in the range of 200° to 350° C.

In conducting the flame-resisting treatment of this invention, it is necessary to apply to the fibers to be treated an elongation of 3% or more, preferably 10% or more, particularly 10 to 30%, until the density of the fibers during the flame-resisting treatment reaches 1.22 g/cm$^3$ and thereafter to suppress substantially the shrinkage of the fibers until completion of the flame-resisting treatment.

When the elongation applied until the density reaches 1.22 g/cm$^3$ is less than 3%, the resultant carbon fiber strand cannot acquire the desired modulus of elasticity and tenacity.

When fibers whose density has reached 1.22 g/cm$^3$ are subjected to a higher-degree flame-resisting treatment, it is unfavorable to conduct the treatment under conditions causing the shrinkage of the yarn because it induces the disturbance of their fine structure, causing the lowering of the tenacity of the resultant carbon fibers.

The above-mentioned elongation behavior of the fibers can be attained, for example, by bringing the fibers into contact with a number of rotating rolls, the rotating speeds of the rolls being increased gradually until the density of the fiber reaches 1.22 g/cm$^3$ and then kept constant thereafter.

The fibers subjected to flame-resisting treatment to attain a density of 1.22 g/cm$^3$ are preferably subjected to a further flame-resisting treatment while being given an elongation of 1% to 10% to attain a density exceeding 1.22 g/cm$^3$ and not more than 1.40 g/cm$^3$, preferably of 1.23 to 1.32 g/cm$^3$. By subjecting acrylonitrile fibers to flame-resisting treatment while applying an elongation to them in the above-mentioned manner, it becomes possible to complete the flame-resisting treatment step while maintaining satisfactorily the fine structures previously imparted to the fibers and thus to produce a high-preformance carbon fiber strand therefrom.

To the fibers subjected to the flame-resisting treatment is further applied an elongation of 3% or more, preferably 5% or more at the time when they are subjected to the primary carbonization treatment in an inert atmosphere such as nitrogen or argon gas in the temperature range of 300° to 800° C. When the elongation is less than 3% in said treatment, it is difficult to obtain the desired modulus of elasticity and tenacity. When the temperature is below 300° C. or over 800° C., the effect of the treatment cannot be exhibited. The treatment is usually conducted for several tens of seconds to several minutes.

Further, a carbon fiber strand of still higher preformance can be obtained by using a process which comprises, in the above-mentioned primary carbonization treatment in an inert atmosphere in the temperature range of 300° to 800° C., applying to the fibers an elongation of 3% or more in the temperature range of 300° to 500° C. and further applying an elongation of 3% or more in the temperature range of 500° to 800° C. The elongation can be conducted, for example, by dividing the primary carbonization furnace into two parts and providing a roll between them. This elongation treatment makes the fine structure formed during the carbonization process more perfect and consequently increases the modulus of elasticity and the tenacity of the resulting carbon fiber strand.

When the elongation treatment is conducted while keeping the elongation and the temperature in the treatment in the above-mentioned ranges, the effect of the treatment can be markedly increased. The treatment is usually conducted for a period preferably in the range of several tens of seconds to several hours.

Following the primary carbonization treatment, the secondary carbonization treatment, namely the ultimate heat treatment, is conducted under tension in an inert atmosphere in the temperature range of 1300° to 1650° C. for several tens of seconds to several minutes. In the heat-treatment, when the maximum temperature during the treatment process is lower than 1300° C., the intended modulus of elasticity cannot be obtained, whereas when the maximum temperature exceeds 1650° C., the tenacity and the density are lowered below the intended values.

The temperature profile in the heat treatment is preferably set up in such a way that the temperature rises from about 1000° C. gradually to the maximum temperature. The tension applied to the fiber during the heat treatment should be 250 mg/denier or more, preferably 350 mg/denier or more. When the tension is lower than the above value, the intended modulus of elasticity can hardly be obtained.

This invention will be concretely illustrated below with reference to Examples.

The strand tenacity and the strand modulus of elasticity were determined according to the methods of JIS R 7601. The density was determined by the density-gradient tube method.

The diameter of carbon fibers was determined by the laser method. The degree of orientation $\pi$ of the acrylic fibers was calculated by the following equation:

$$\pi = \frac{180 - H^{\frac{1}{2}}}{180} \times 100\ (\%)$$

from the half-value width $H^{\frac{1}{2}}$ (day) of the scattering intensity distribution in the direction of the azimuth angle in the reflection of $2\theta = 17°$ (Cu-K $\alpha$ ray being used).

EXAMPLE 1

A polymer having a composition of 98 wt % of acrylonitrile, 1 wt % of methyl acrylate and 1 wt % of methacrylic acid and a specific viscosity [$\eta_{sp}$] of 0.20 (intrinsic viscosity [$\eta$]: 1.6) was dissolved to a solid concentration of 26 wt % to form a dope using dimethylformamide as the solvent. The dope was subjected to 10 $\mu$m-filtration and 3 $\mu$m-filtration and then wet-spun into filaments. The filaments were subsequently stretched 5-fold in a hot-water bath, washed, dried and further stretched 1.3-fold in a dry atmosphere at 170° C. to give an acrylic fiber having a number of filaments of 9000 which have a fineness of 0.8 denier. The degree of orientation $\pi$ of the fiber determined by means of X-ray diffraction was 90.3%. The acrylic fibers were subjected to a flame-resisting treatment by passing them through a flame-resisting treatment furnace of hot-air circulation type having a temperature profile of three steps of 220° C.–240° C.–260° C. for 60 minutes, during which treatment an elongation indicated in Table 1 was applied to the fibers until the density of the fiber reached 1.22 g/cm$^3$ and then an elongation indicated in Table 1 was further applied until the density reached 1.25 g/cm$^3$ to complete the flame-resisting treatment.

Then, the fibers subjected to the above flame-resisting treatment were passed through the first carbonization furnace at 600° C. under a pure nitrogen gas stream for 3 minutes, during which an elongation of 10% was applied to the fibers. Then, the fibers were heat-treated under a tension of 400 mg/denier in the second carbonization furnace having a maximum temperature indicated in Table 1 in the same atmosphere as mentioned above to give carbon fibers having properties shown in Table 1.

TABLE 1

| Experiment No. | Elongation in flame-resisting step (%) Until density of 1.22 g/cm$^3$ | Until density of 1.25 g/cm$^3$ | Maximum heat-treatment temp. (°C.) | Strand tenacity (kg/mm$^2$) | Strand module of elasticity (ton/mm$^2$) | Density (g/cm$^3$) | Diameter ($\mu$) |
|---|---|---|---|---|---|---|---|
| 1 | 15 | 0 | 1250° C. | 508 | 26.8 | 1.812 | 5.3 |
| 2 | " | " | 1350 | 515 | 28.3 | 1.803 | 5.3 |
| 3 | " | " | 1450 | 503 | 29.4 | 1.790 | 5.3 |
| 4 | " | " | 1550 | 458 | 30.2 | 1.773 | 5.3 |

TABLE 1-continued

| Experiment No. | Elongation in flame-resisting step (%) Until density of 1.22 g/cm³ | Until density of 1.25 g/cm³ | Maximum heat-treatment temp. (°C.) | Strand tenacity (kg/mm²) | Strand module of elasticity (ton/mm²) | Density (g/cm³) | Diameter (μ) |
|---|---|---|---|---|---|---|---|
| 5 | 20 | 3 | 1250 | 550 | 27.1 | 1.813 | 5.3 |
| 6 | " | " | 1350 | 555 | 28.5 | 1.804 | 5.3 |
| 7 | " | " | 1450 | 548 | 29.8 | 1.790 | 5.3 |
| 8 | " | " | 1550 | 527 | 30.5 | 1.773 | 5.3 |
| 9 | " | " | 1600 | 458 | 30.8 | 1.759 | 5.2 |

EXAMPLE 2

The process of Example 1 was repeated except that the elongation in the flame-resisting treatment and the temperature as well as the elongation in the first carbonization furnace were altered In the second carbonization furnace, the maximum temperature was 1450° C. and the tension was 380 mg/denier. The properties of carbon fibers obtained are shown in Table 2.

TABLE 2

| Experiment No. | Elongation in flame-resisting treatment (%) | First carbonization furnace temp. (°C.) | Elongation at first carbonization furnace (%) | Strand tenacity (kg/mm²) | Strand modulus of elasticity (ton/mm²) | Density (g/cm³) | Diameter (μ) |
|---|---|---|---|---|---|---|---|
| 10 | 5 | 450 | 15 | 451 | 28.5 | 1.792 | 5.5 |
| 11 | 25 | 550 | 8 | 498 | 29.6 | 1.790 | 5.3 |
| 12 | 35 | 700 | 4 | 445 | 30.0 | 1.788 | 5.2 |

EXAMPLE 3

The process of Example 1 was repeated except that the orifice diameter of the spinning nozzle, output rate of the dope in spinning, and the draw ratio were altered to obtain acrylic fibers having a fineness shown in Table 3.

These acrylic fibers were subjected to a flame-resisting treatment under the same conditions as those in No. 3 of Table 1 in Example 1. In the treatment, the maximum temperature and the tension in the ultimate heat-treatment were 1450° C. and 400 mg/denier, respectively. The physical properties of the carbon fibers obtained are shown in Table 3.

TABLE 3

| Experiment No. | Acrylic fiber fineness (denier) | Strand tenacity (kg/mm²) | Strand modulus of elasticity (ton/mm²) | Density (g/cm³) | Diameter (μ) |
|---|---|---|---|---|---|
| 13 | 0.2 | 517 | 30.4 | 1.787 | 2.7 |
| 14 | 0.6 | 556 | 29.7 | 1.792 | 4.6 |
| 15 | 1.0 | 533 | 28.4 | 1.788 | 5.9 |
| 16 | 1.3 | 512 | 27.5 | 1.790 | 6.9 |

EXAMPLE 4

The acrylonitrile-type fibers prepared in Example 1 were subjected to a flame-resisting treatment under an elongation applied as shown in Table 1 in a flame-resisting treatment furnace having the same temperature profile as that used in Example 1, and were then carbonized under a primary carbonization condition of a temperature of 550° C. and a secondary carbonization temperature of 1450° C. and a tension of 380 mg/denier. The characteristics of the carbon fiber strand thus obtained are shown in Table 4.

TABLE 4

| Experiment No. | Elongation in flame-resisting treatment (%) Until density of 1.22 g/cm³ | Until density of 1.25 g/cm³ | Elongation at 1st carbonization furnace (%) | Strand tenacity (kg/mm²) | Strand modulus of elasticity (ton/mm²) | Density (g/cm³) | Diameter (μ) |
|---|---|---|---|---|---|---|---|
| 17 | 5 | 10 | 15 | 486 | 29.3 | 1.792 | 5.3 |
| 18 | 10 | 10 | 8 | 521 | 29.4 | 1.792 | 5.3 |
| 19 | 20 | 3 | 8 | 550 | 29.9 | 1.789 | 5.3 |
| 20 | 30 | 1 | 3 | 511 | 30.1 | 1.789 | 5.3 |

EXAMPLE 5

Flame-resisting treatment of a yarn was conducted under conditions shown in Table 1 in Example 1, and the treated yarn was heat-treated in the first carbonization furnace at varied temperatures and then heat-treated in the second carbonization furnace at a temperature of 1450° C. and under a tension of 400 mg/denier. The results obtained are shown in Table 5.

TABLE 5

| Experiment No. | 1st carbonization furnace temperature (°C.) | Strand tenacity (kg/mm²) | Strand modulus of elasticity (ton/mm²) | Density (g/cm³) |
|---|---|---|---|---|
| 21 | 350 | 475 | 29.4 | 1.806 |
| 22 | 550 | 556 | 29.9 | 1.790 |
| 23 | 750 | 538 | 29.7 | 1.793 |

EXAMPLE 6

The acrylonitrile-type fibers prepared in Example 1 were subjected to a flame-resisting treatment by passing them for 60 minutes in a flame-resisting treatment furnace of a hot-air circulation type having a three-steps temperature profile of 220° C.-240° C.-260° C., during which an elongation of 15% was applied to the fibers by means of the difference of the velocity of rotating rolls until the density of the fibers reached 1.22 g/cm$^3$ and thereafter the local shrinkage of the fibers was suppressed by fixing the velocity of the rotating rolls contacting with the fibers at a constant value until completion of the flame-resisting treatment.

Then, the thus treated fibers were passed through the first carbonization furnace at 450° C. in a pure nitrogen gas stream under an applied elongation of 12%, then further through the second carbonization furnace at 650° C. in the same atmosphere as above under an applied elongation of 4%, and subsequently heat-treated in the third carbonization furnace having the maximum temperature shown in Table 6 in the same atmosphere as above under a tension of 380 mg/denier. Thus, carbon fibers having physical properties shown in Table 6 were obtained.

TABLE 6

| Experiment No. | Max. heat-treatment temp. (°C.) | Strand tenacity (mg/mm$^2$) | Strand modulus of elasticity (ton/mm$^2$) | Density (g/cm$^3$) | Diameter (μ) |
|---|---|---|---|---|---|
| 24 | 1250 | 553 | 27.7 | 1.815 | 5.3 |
| 25 | 1350 | 565 | 29.1 | 1.808 | 5.3 |
| 26 | 1450 | 550 | 30.3 | 1.795 | 5.3 |

TABLE 6-continued

| Experiment No. | Max. heat-treatment temp. (°C.) | Strand tenacity (mg/mm$^2$) | Strand modulus of elasticity (ton/mm$^2$) | Density (g/cm$^3$) | Diameter (μ) |
|---|---|---|---|---|---|
| 27 | 1550 | 533 | 30.9 | 1.774 | 5.3 |

EXAMPLE 7

The process of Example 6 was repeated up to the second carbonization except that the temperature and the elongation in the heat-treatment in the first and the second carbonization furnace were altered as shown in Table 7. Then, the carbonization treatment in the third carbonization furnace was conducted at a maximum temperature of 1450° C. and under a tension of 380 mg/denier. The physical properties of the carbon fibers thus obtained are shown in Table 7.

TABLE 7

| Experiment No. | 1st carbonization furnace Temperature (°C.) | 1st carbonization furnace Elongation (%) | 2nd carbonization furnace Temperature (°C.) | 2nd carbonization furnace Elongation (%) | Strand tenacity (kg/mm$^2$) | Strand modulus of elasticity (ton/mm$^2$) | Density (g/cm$^3$) | Diameter (μ) |
|---|---|---|---|---|---|---|---|---|
| 28 | 350 | 10 | 550 | 10 | 538 | 30.4 | 1.795 | 5.3 |
| 29 | 450 | 5 | 650 | 10 | 560 | 30.0 | 1.794 | 5.3 |
| 30 | 450 | 25 | 650 | 2 | 516 | 30.5 | 1.797 | 5.2 |
| 31 | 500 | 15 | 750 | 3 | 551 | 30.3 | 1.795 | 5.3 |

INDUSTRIAL APPLICABILITY

The present invention provides a novel carbon fiber having a fiber diameter of 1 to 6 μm, a strand tenacity of 430 kg/mm$^2$ or more, a strand modulus of elasticity of 28 ton/mm$^2$ or more, and a density of 1.755 g/cm$^3$ or more. The fiber has extremely useful properties as a raw material for composite materials to be used not only for sporting goods such as fishing rods or golf clubs but also in aerospace industries.

We claim:

1. A carbon fiber of a high tenacity and a high modulus of elasticity which has a fiber diameter of 1-6 microns, a strand tenacity of 503 kg/mm$^2$ or more, a strand modulus of elasticity of 28 ton/mm$^2$ or more and a density of 1.773 g/cm$^3$ or more.

2. The carbon fiber of claim 1 wherein said fiber has a strand modulus of elasticity of 28.5 ton/mm$^2$.

* * * * *

UNITED STATES PATENT AND TRADEMARK OFFICE

CERTIFICATE OF CORRECTION

PATENT NO. : 5,281,477

DATED : January 25, 1994

INVENTOR(S) : Munetsugu NAKATANI, et al.

It is certified that error appears in the above-indentified patent and that said Letters Patent is hereby corrected as shown below:

On the title page, Item [63], the Related U.S. Application Data should read as follows:

--Continuation of Ser. No. 120,691, Nov. 9, 1987, abandoned, which is a continuation of Ser. No. 731,950, Apr. 26, 1985, filed as PCT/JP84/00486, Oct. 12, 1984, abandoned.--

Signed and Sealed this

Second Day of August, 1994

Bruce Lehman

*Attest:*

BRUCE LEHMAN

*Attesting Officer*

*Commissioner of Patents and Trademarks*